US006422051B1

(12) United States Patent
Kuo

(10) Patent No.: US 6,422,051 B1
(45) **Date of Patent: *Jul. 23, 2002**

(54) COMBINATION CABLE LOCK

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/528,726

(22) Filed: Mar. 20, 2000

Related U.S. Application Data

(63) Continuation-in-part of application No. 09/318,874, filed on May 26, 1999, now abandoned, which is a continuation-in-part of application No. 09/001,212, filed on Dec. 30, 1997, now Pat. No. 5,934,120.

(30) Foreign Application Priority Data

Dec. 5, 1997 (TW) ..... 86220272 U

(51) Int. Cl.[7] ..... E05B 37/02
(52) U.S. Cl. ..... 70/312; 70/316; 70/323
(58) Field of Search ..... 70/312, 30, 316, 70/317, 318, 323, 324, 315, 26

(56) References Cited

U.S. PATENT DOCUMENTS 5,027,623 A * 7/1991 Ling ..... 70/26
5,934,120 A * 8/1999 Kuo ..... 70/312

* cited by examiner

*Primary Examiner*—Yonel Beaulieu
(74) *Attorney, Agent, or Firm*—Patterson, Thuente, Skaar & Christensen, P.A.

(57) ABSTRACT

A combination cable lock includes a cable, a support rod attached to the one end of the cable, multiple first and second locking lugs respectively formed on opposite sides of the support rod, each of the second locking lugs having a dimension different from that of the first locking lug, multiple tumblers each including a number wheel rotatably mounted on the support rod, a follower detachably secured in the number wheel, and containing a first locking recess aligning with and having a dimension corresponding to the first locking lugs, and a second locking recess aligning with and having a dimension corresponding to the second locking lugs, and a number reset device abutting one of the tumblers to detach the follower from the number wheel such that the number wheel can be rotated relative to the follower.

5 Claims, 5 Drawing Sheets

COMBINATION CABLE LOCK

CROSS-REFERENCES TO RELATED APPLICATIONS

The present invention is a continuation-in-part application of the U.S. Ser. No. 09/318,874, filed on May 26, 1999, now abandoned which is a continuation-in-part of Ser. No. 09/001,212 now U.S. Pat. No. 5,934,120.

BACKGROUND OF THE INVENTION

1. Field of the Invention

The present invention relates to a combination cable lock, and more particularly to a combination cable lock which can be reset.

2. Description of the Related Art

The closest prior arts of which the applicant is aware of are disclosed in U.S. Pat. No. 5,653,134 to Huang, U.S. Pat. No. 5,235,831 to Laurin et al., U.S. Pat. No. 5,027,623 to Ling, U.S. Pat. No. 5,636,539 to Tsai and U.S. Pat. No. 5,934,120 to Kuo. Within which, the most related patents are the Ling patent (hereinafter referred to as '623) and the Kuo patent (hereinafter referred to as '120 ). The focus of the following discussion will be on these two patents. The '623 patent relates to a combination cable lock having a spindle with a longitudinal notch defined to receive one of the multiple projections formed on the bolt. The sleeve has a combination-changing slot corresponding to the extensions radially protruding out from a cylindrical surface of the spindle. With such an arrangement, when the combination lock just described is in assembly, by chance, the angle of the corresponding parts can be incorrectly assembled. That is, the projection can be received in the slot and the extension can be receive in the notch, which nevertheless can still he successfully assembled, the function that a combination lock is supposed to have is not able to function normally. In another word, even when the assembly of the parts of the lock base is successful, the lock bolt still can not extend into the lock base to work normally as a combination lock.

The '120 patent has a tube that has a smooth cylindrical surface defined therein a pair of opposed orifices and an axial slot corresponding to the third gap of the internal ring so as to allow the insertion of the rod with tooth bar integrally formed with the rod. When the combination lock of the '120 patent is in assembly and before the insertion of the rod into the corresponding axial slot, the tube together with the other parts except the rod may be incorrectly assembled, such that the rod will have no corresponding axial slot to be inserted, which is because there is no devices or member designed to prevent the assembly sequence from being incorrectly assembled.

To overcome the aforementioned problems, the combination cable lock constructed in accordance with the present invention provides a means to avoid the problem of mis-assembly.

BRIEF SUMMARY OF THE INVENTION

In accordance with one aspect of the present invention, there is provided a combination cable lock comprising a cable, a retaining member mounted on one end of the cable, and including a support rod, multiple separate first locking lugs formed on the outside of the support rod, multiple separate second locking lugs formed on the opposite side of the support rod and radially corresponding to one of the first locking lugs, each of the second locking lugs having a dimension different from that of the respective first locking lugs, multiple tumblers each rotatably mounted on the support rod and including a number wheel, a follower detachably secured in the number wheel to rotate therewith, a push disk slidably secured in the number wheel and abutting the follower, and a torsion spring attached to the push disk and secured in the number wheel, a number reset device mounted on the support rod and abutting one of the tumblers to detach the follower from the number wheel such that the number wheel can be rotated relative to the follower, a locking member mounted on the second end of the cable, and including a locking rod detachably secured in the support rod by the tumblers, and a compression spring mounted on the support rod and located between one of the tumblers and the retaining member.

The follower contains a first locking recess aligning with and having a dimension corresponding to the first locking lugs, and a second locking recess aligning with and having a dimension corresponding to the second locking lugs, Further benefits and advantages of the present invention will become apparent after a careful reading of the detailed description with appropriate reference to the accompanying drawings.

DETAILED DESCRIPTION OF THE INVENTION

Figure 1:
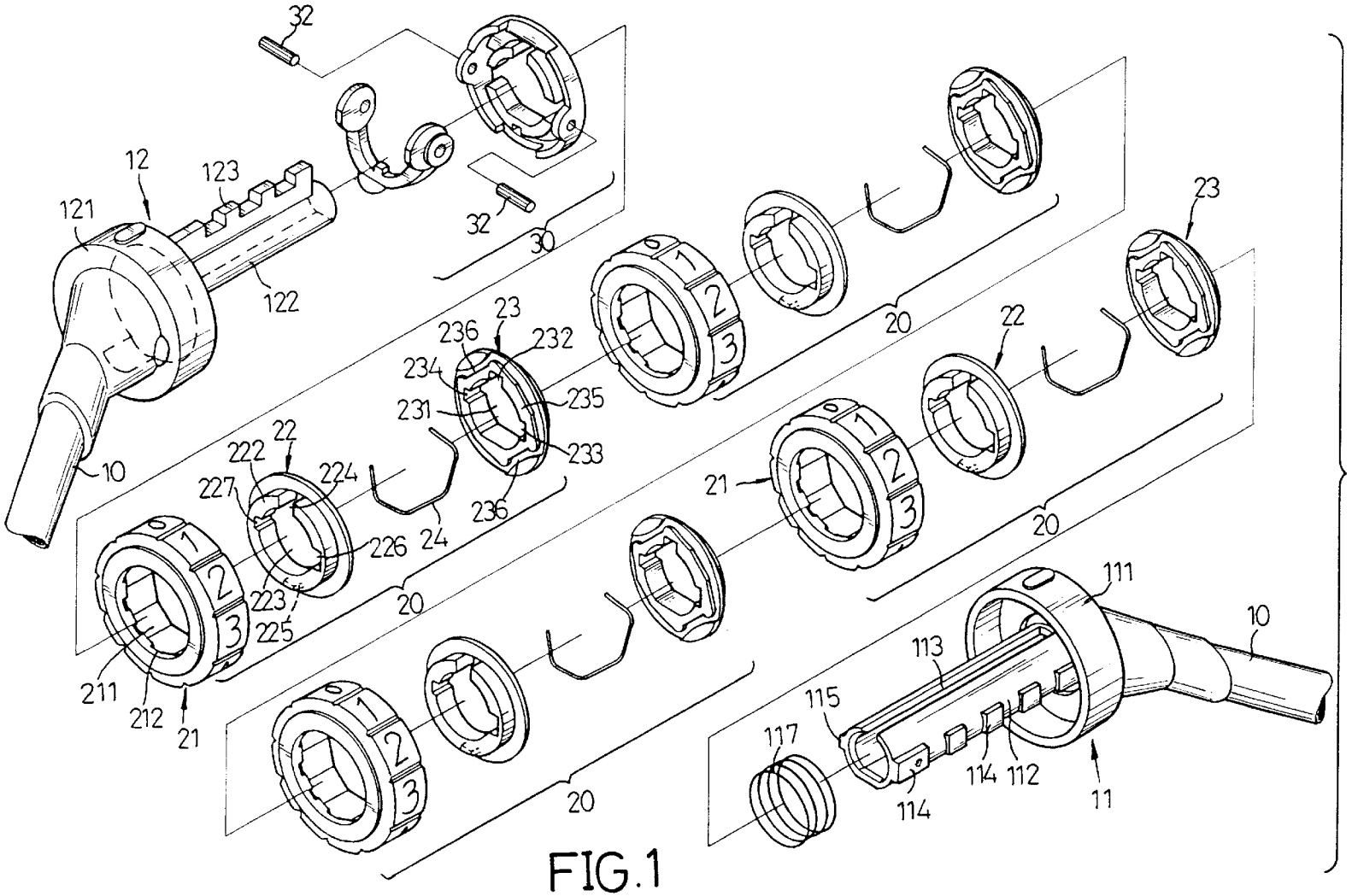
FIG. 1 is an exploded perspective view of a combination cable lock in accordance with the present invention.
Figure 3:
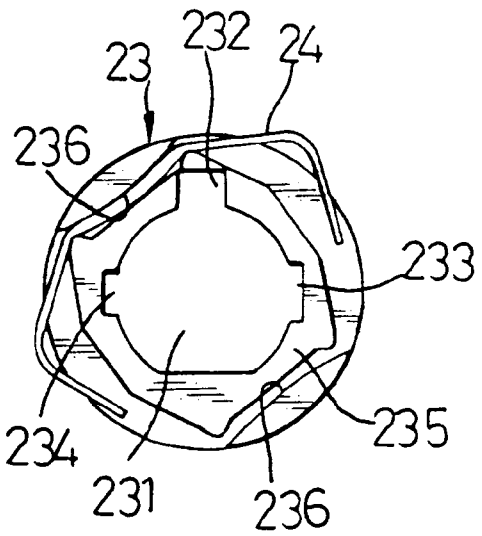
FIG. 3 is a end plan view of another embodiment of the push disk of the combination cable lock as shown in FIG. 1.
Figure 2:
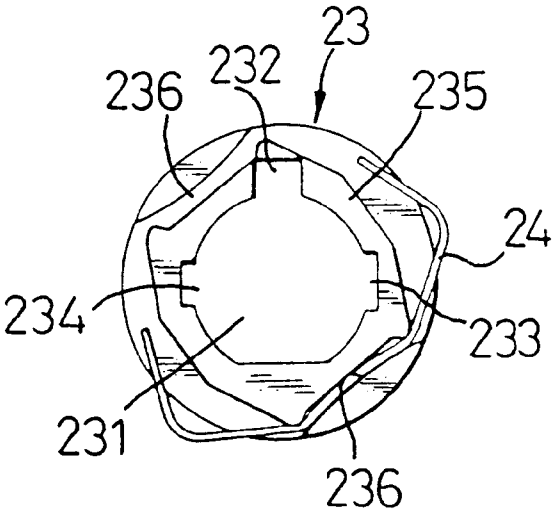
FIG. 2 is an end plan view of the push disk of the combination cable lock as shown in FIG. 1.

Referring to the drawings and initially to FIGS. 1–5, a combination cable lock in accordance with the present invention can be reset and comprises a cable (10), a retaining member (11) mounted on one end of the cable (10) and including a ring base (111) and a support rod (112), multiple linear first locking lugs (114) formed on one side of the support rod (112), multiple linear second locking lugs (115) formed on the opposite side of the support rod (112) with respect to the first locking lugs (114) and corresponding to one of the first locking lugs (114), each of the second locking lugs (115) having a dimension smaller than that of the respective first locking lug (114) or a shape different from that of the respective first locking lug (114), a tumbler (20) corresponding to each pair of first and second locking lugs (114,115) and rotatably mounted on the support rod (112), and each including a number wheel (21) containing a center hole (211), a follower (22) detachably secured in the number wheel (21) to rotate therewith, a push disk (23) slidably secured in the number wheel (21) and abutting the follower (22), a torsion spring (24) attached to the push disk (23) to secure the push disk (23) in the number wheel (21), a number reset device (30) secured to the support rod (112) by means of two locking pins (32) and abutting one of the tumblers (20) to detach the follower (22) from the number wheel (21) such that the number wheel (21) can be rotated relative to the follower (22), a locking member (12) mounted on the second end of the cable (10) and including a ring base (121) and a locking rod (122) detachably secured in the support rod (112) by the tumblers (20), and a compression spring (117) mounted on the support rod (112) and located between one of the tumblers (20) and the retaining member (11).

The follower (22) includes an annular flange (222) abutting the number reset device (30) and contains a center hole (223), a first locking recess (226) aligning with and having a dimension corresponding to the first locking lugs (114) and a second locking recess (227) aligning with and having a dimension corresponding to the second locking lugs (115).

The push disk (23) contains a first mating recess (233) aligning with and having a dimension corresponding to the first locking lugs (114), and a second mating recess (234) aligning with and having a dimension corresponding to the second locking lugs (115). The push disk (23) includes an abutting piece (235) abutting the follower (22), and contains two retaining grooves (236) to retain the torsion spring (24) therein.

The number wheel (21) contains multiple locking notches (212), and the follower (22) includes a locking boss (225) detachably received in one of the corresponding locking notches (212).

The support rod (112) of the retaining member (11) contains an longitudinal slot (113), the locking rod (122) of the locking member (12) includes multiple separate locking teeth (123) slidably received in the opening (113), the annular flange (222) of the follower (22) contains a channel (224) aligning with the locking teeth (123), and the push disk (23) contains a passage (232) aligning with the locking teeth (123).

In operation, the locking boss (225) of the follower (22) is initially received in one of the locking notches (212) of the number wheel (21) such that the follower (22) is rotated with the number wheel (21). The push disk (23) is secured in the number wheel (21) by the torsion spring (24) such that the push disk (23) also rotates with the number wheel (21).

Figure 4:
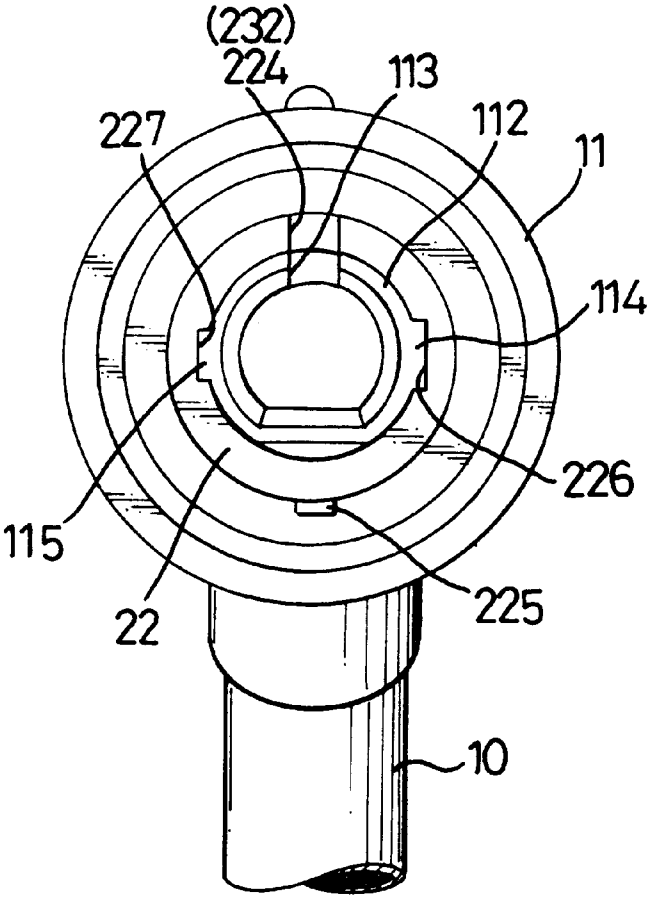
FIG. 4 is an end plan view of the combination cable lock as shown in FIG. 1.

Each of the tumblers (20) is initially rotated relative to the support rod (112) so as to align the channel (224) of the follower (22) and the passage (232) of the push disk (23) with the opening (113) of the support rod (112) as shown in FIG. 4. The locking rod (122) is then inserted into the support rod (112) with the locking teeth (123) in turn extending through the channel (224) and the passage (232) of each of the tumblers (20), and through the opening (113). The tumblers (20) are then rotated relative to the support rod (112) to block the locking teeth (123), thereby locking the locking rod (122) to the support rod (112) by the tumblers (20).

Figure 5:
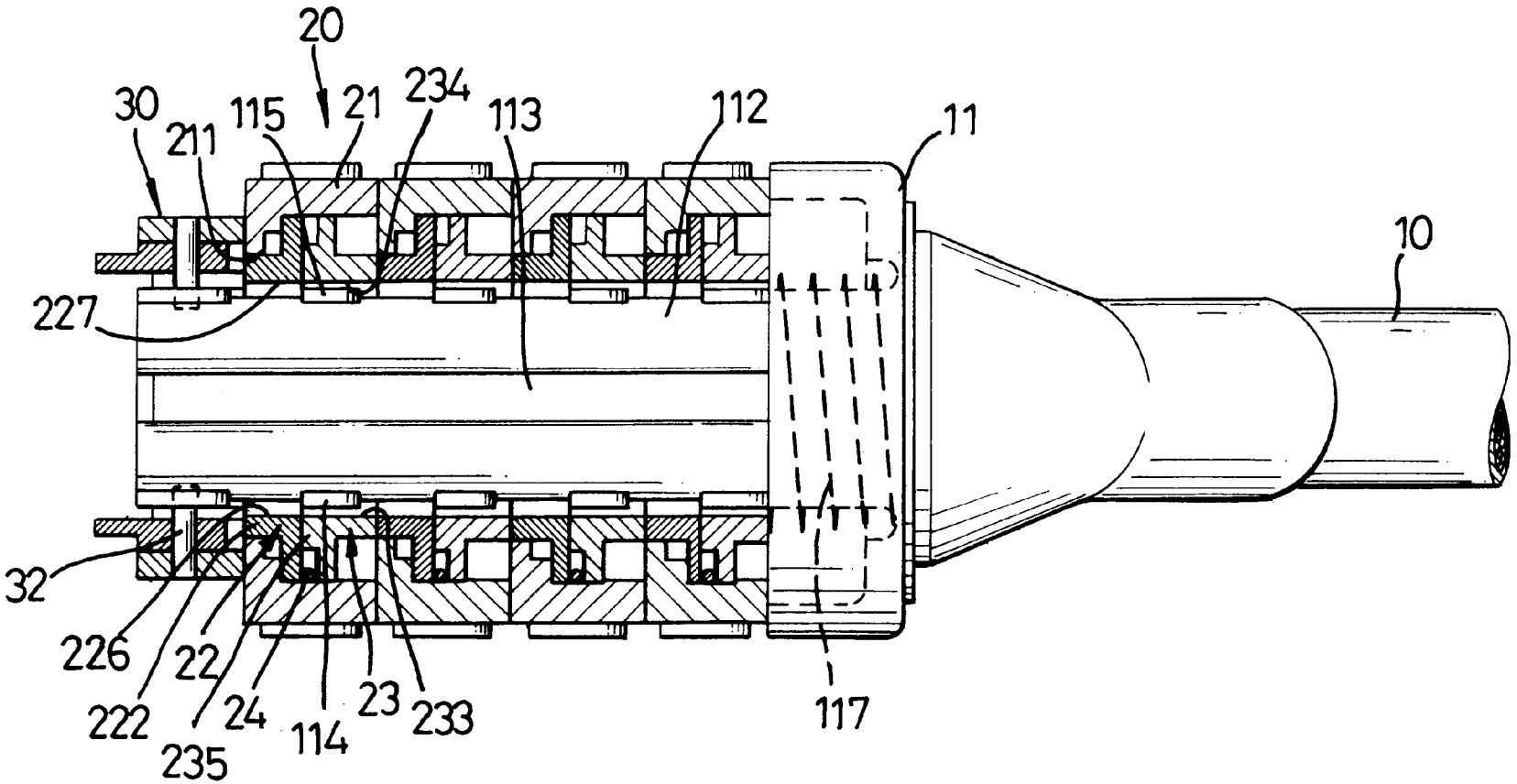
FIG. 5 is a side plan cross-sectional view of the combination cable lock as shown in FIG. 1.
Figure 6:
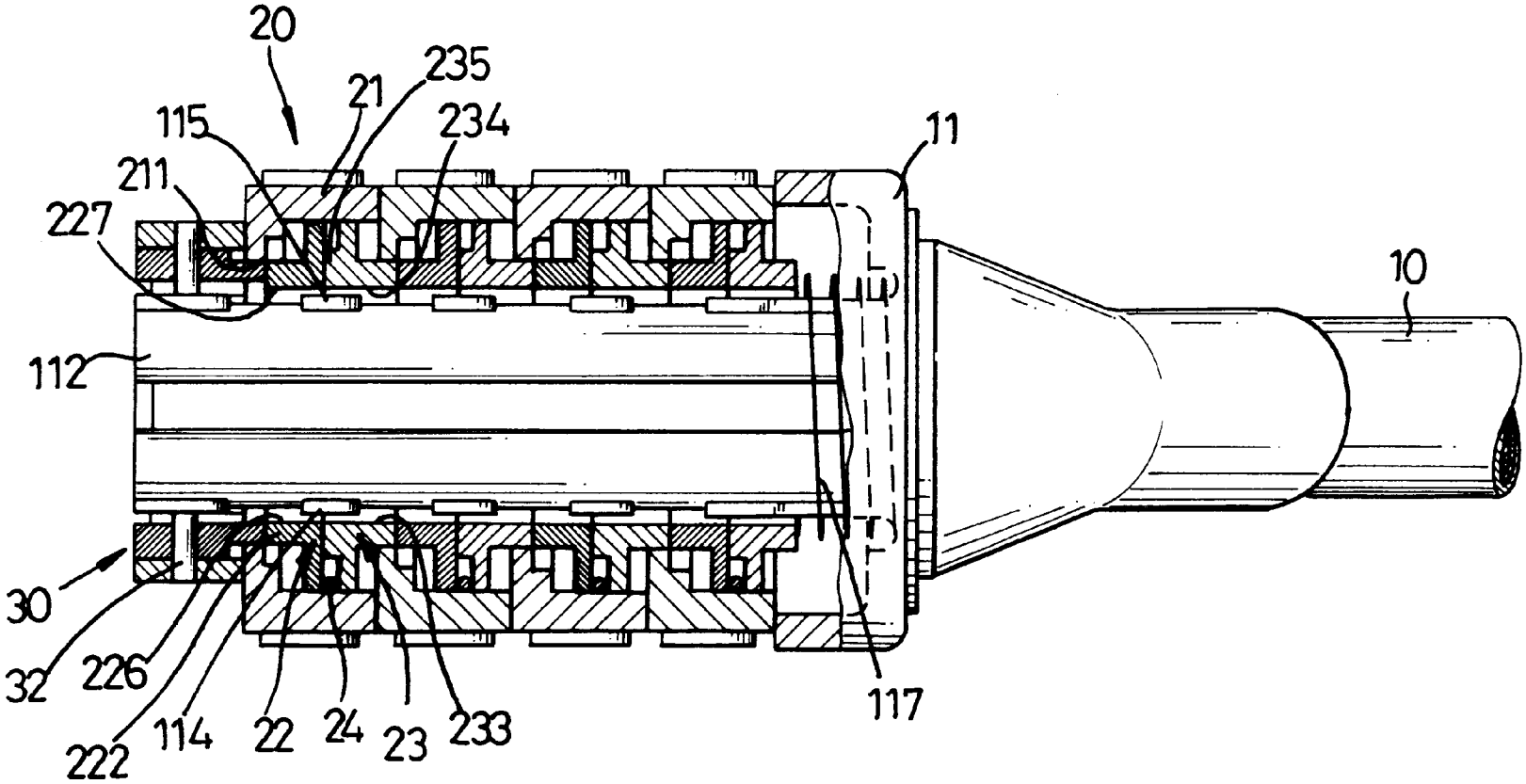
FIG. 6 is an operational view of the combination cable lock as shown in FIG. 5.

Referring to FIGS. 5 and 6 with reference to FIG. 1, when the intent is to reset the code number of the number wheel (21) of each of the tumblers (20), the number reset device (30) is operated to push the annular flange (222) and the push disk (23) of each of the tumblers (20) toward the retaining member (11) to move from the position as shown in FIG. 5 to the position as shown in FIG. 6 so as to release the locking boss (225) from the locking notch (212), thereby detaching the follower (22) of each of the tumblers (20) from the number wheel (21). In the mean time, each of the first locking lugs (114) is received in the respective first locking recess (226), and each of the second locking lugs (115) is received in the respective second locking recess (227), thereby securing the follower (22) of each of the tumblers (20) to the support rod (112) such that the number wheel (21) can be rotated relative to the follower (22) to reset the code number. Because the dimensions and the shapes of the first locking lugs (114) and the second locking lugs (115) are not the same, when the respective first locking lugs (114) is received in the corresponding first locking recess (226) and the respective second locking lugs (15) is received in the corresponding second locking recess (227), correct assembly of the combination cable lock of the invention is assured.

When the code number of the number wheel (21) of each of the tumblers (20) is reset, the number reset device (30) is returned to its original position such that the follower (22) and the push disk (23) of each of the tumblers (20) are returned to their initial positions as shown in FIG. 5 by means of the returning force of the compression spring (117), thereby moving the locking boss (225) to be received into another locking notch (212) to secured the follower (22) to the number wheel (21) such that the follower (22) is rotated with the number wheel (21) again.

It should be clear to those skilled in the art that further embodiments may be made without departing from the scope of the present invention.

What is claimed is:

1. A combination lock comprising:

a cable (10)

a retaining member (11) attached to one end of said cable (10), and including a support rod (112), multiple separate first locking lugs (114) formed on the outside of said support rod (112), multiple separate second locking lugs (115) formed on the opposite side of said support rod (112), each of said second locking lugs (115) having a dimension different from that of said respective first locking lug (114);

multiple tumblers (20) corresponding to the pairs of first and second locking lugs (114, 115) each rotatably mounted on said support rod (112), and each including a number wheel (21), a follower (22) detachably secured in said number wheel (21) to rotate therewith, a push disk (23) slidably secured in said number wheel (21) and abutting said follower (22), a torsion spring (24) attached to said push disk (23) and secured in said number wheel (21), said follower (22) defining a first locking recess (226) aligning with and having a dimension corresponding to said first locking lugs (114) and a second locking recess (227) aligning with and having a dimension corresponding to said second locking lugs (115);

wherein said push disk (23) defines a first mating recess (233) aligning with and having a dimension corresponding to said first locking lugs (114), and a second mating recess (234) aligning with and having a dimension corresponding to said second locking lugs (115);

a number reset device (30) mounted on said support rod (112) and abutting one of said tumblers (20) to detach said follower (22) from said number wheel (21) such that said number wheel (21) can be rotated relative to said follower (22); a locking member (12) mounted on the other end of said cable (10), and including a locking rod (122) detachably secured in said support rod (112) by said tumblers (20); and a compression spring (117) mounted on said support rod (112), and located between one of said tumblers (20) and said retaining member (11);

whereby the corresponding relationship of the first and second locking lugs (114, 115) and the first and second recesses (226, 227) and the first and second mating recesses assure that the lock will be assembled with a correct assembled angle.

2. The combination cable lock in accordance with claim 1, wherein said push disk (23) includes an abutting piece (235) abutting said follower (22), and containing at least one retaining groove (236) to retain said torsion spring (24) therein, wherein said follower (22) includes an annular flange (222) abutting said number reset device (30).

3. The combination cable lock in accordance with claim 2, wherein said number wheel (21) contains multiple locking notches (212), and said follower (22) includes a locking boss (225) detachably received in one of said corresponding locking notches (212).

4. The combination cable lock in accordance with claim 3, wherein said support rod (112) of said retaining member (11) contains an longitudinal slot (113), said locking rod (122) of said locking member (12) includes multiple separate locking teeth (123) slidably received in said opening (113), said follower (22) contains a channel (224) aligning with said locking teeth (123), and said push disk (23) contains a passage (232) aligning with said locking teeth (123).

5. The combination cable lock in accordance with claim 1 wherein the shapes of the first locking lug and the second locking lug (114,115) are not the same, such that the combination between the first locking lug (114), the second locking lug (115) and the corresponding locking recesses (226,227) is ensured.

* * * * *